United States Patent [19]

Wandler et al.

[11] 4,440,993

[45] Apr. 3, 1984

[54] TIMER DEVICE AND METHOD OF OPERATING

[75] Inventors: Richard A. Wandler, Clinton, Iowa; Kenneth R. Renkes, Fenton, Ill.

[73] Assignee: General Electric Company, Fort Wayne, Ind.

[21] Appl. No.: 408,797

[22] Filed: Aug. 17, 1982

[51] Int. Cl.[3] ..... H01H 7/08

[52] U.S. Cl. ..... 200/38 R; 200/38 A; 200/38 FA; 368/108

[58] Field of Search ..... 200/35 R, 38 FA, 38 R, 200/38 A; 368/107, 108

[56] References Cited

U.S. PATENT DOCUMENTS

| | | | |
|---|---|---|---|
| 3,548,126 | 12/1970 | Bassett | 200/38 R |
| 3,568,429 | 3/1971 | DeLille | 368/108 |
| 3,941,000 | 3/1976 | Allison, Jr. | 200/38 FA |
| 4,041,424 | 8/1977 | Harris | 200/38 F |
| 4,302,639 | 11/1981 | Lewis et al. | 200/38 BA |

*Primary Examiner*—E. A. Goldberg
*Assistant Examiner*—Morris Ginsburg
*Attorney, Agent, or Firm*—Joseph E. Papin

[57] ABSTRACT

A method of operating a timer device having means for indicating the remaining operating time during an operating time period selected for the timer device. The timer device includes a gear train having a pair of branches coupled with the indicating means to drive it in different preselected speed modes through the selected operating time period. In this method, the indicating means is driven in one of the preselected speed modes through one of the gear train branches during an operating time period in excess of a predetermined operating time period of the timer device with the sum of the excess and predetermined operating time periods comprising the selected operating time period, and the drive of the indicating means through the other of the gear train branches is obviated during the excess operating time period. At least one of the gears in the one gear train branch is moved to a position disengaged from mesh with at least another of the gears of the one gear train branch interrupting the drive therethrough of the indicating means to terminate the excess operating time period, and thereafter the indicating means is driven through the other gear train branch during the predetermined operating time period of the timer device.

Timer devices and other operating methods are also disclosed.

20 Claims, 7 Drawing Figures

TIMER DEVICE AND METHOD OF OPERATING

CROSS-REFERENCE TO RELATED PATENT

This application is related to U.S. Pat. No. 3,941,000 issued Mar. 2, 1976 to Ralph H. Allison, Jr., which is incorporated by reference herein.

FIELD OF THE INVENTION

This invention relates in general to mechanisms utilized in the timed control of associated apparatus and in particular to timer devices and methods of operating a timer device.

BACKGROUND OF THE INVENTION

In the past, various and sundry types of expanded scale or dual speed timers have been utilized in laboratories, factories, and homes for controlling the operating time or cycle of devices requiring rather accurate time measurements for relatively short periods of time but also having timing cycles which may extend over relatively longer periods of time. For instance, one of the more prevalent uses for expanded scale timers is in conjunction with various home appliances, such as an oven or the like. Many of the modern day foods may require only a short period of time for cooking, e.g. about five or ten minutes; therefore, it is necessary to accurately time the cooking period for such foods in order to obviate overcooking or perhaps burning them. Further, at least some of the modern day ovens, such as an induction type cooking unit or mechanical vibration type cooking unit as well known in the art, are operable to prepare or cook foods in a relatively short period of time as compared with a conventional oven; therefore, it is necessary to accurately time the cooking or operating cycle of such modern day ovens over such relatively short period of time in order to prevent overcooking or perhaps burning of some foods. Quite obviously, it is also desirable to provide a longer cooking cycle or operating time period for both the conventional type oven and the modern day induction and mechanical vibration type ovens. In order to achieve such accurate regulation or timing during relatively short time periods, the timing scale for the past timers has been elongated or expanded for the relatively short time periods, ie., from zero to five or ten minutes, so that the desired time setting for any particular operating or timing cycle may be more accurately achieved within the elongated or expanded setting ranges for the shorter periods of time. For instance, in a dial having angularly spaced dial settings from 0° to 360°, the expanded time settings for the relatively short time period of five minutes may occupy the first 165° to 180° of the 360° dial settings, and the successive relatively long time period, i.e., from about thirty minutes to several hours, may occupy the following 165° to 180° of the 360° dial settings. Of course, in order to compensate for the above-discussed expanded time scale for the relatively short period of time, the past timers were operated at a relatively high speed during the short time period in the elongate scale and at a lower speed during the long time period.

In some of the past expanded scale timers in order to attain the high and low speed or dual speed operation thereof, separate motive force applying or motor pinions were driven by separate electric motors, and these motor pinions were clutched together by a cam operated shift arm engaging or disengaging between the motor pinions in overriding relation to effect the dual speed operation. Of course, it is believed that a disadvantageous or undesirable feature of this particular type of past expanded scale timer was not only the expense of providing separate motors for operating it but also the complexity of regulating or clutching them to attain the dual speed operation.

In some other types of past expanded scale timers, two sector-shaped gears of different diameters were conjointly driven and had their respective teeth portions off-set with respect to each other thereby to engage successively with two mating pinion gears also of different diameters in order to effect dual speed operation of such past expanded scale timer. One of the disadvantageous features of this type of past expanded scale timer is believed to be the problem of angularly positioning the sector-shaped gears, i.e., accurately spacing the sector-shaped gears from each other in order to achieve successive and uninterrupted meshing of their respective teeth portions with the associated pinion gearing. In an attempt to overcome this disadvantageous feature, the adjacent ends of the sector-shaped gears were overlapped; however, it is believed that in itself created another disadvantageous feature in that each time the timer translated from the low speed to the high speed operation thereof, the gearing could be mismeshed or be in interfering engagement. Even though it may be possible to overcome or properly design around this gearing interfering engagement or disadvantageous feature, it may require the development of special gearing which in itself may disadvantageously add to the complexity as well as the cost of this type of expanded scale timer.

In still another type of past expanded scale timer, a low speed pinion and a high speed pinion were driven by an electric motor, and a time interval gear mounted on the time set shaft was axially movable both manually and automatically into and out of engagement with the low and high speed pinions thereby to effect the low and high speed modes of operation. A latch cam was operative to axially move the set shaft so that the time interval gear was automatically axially moved therewith toward engagement with the high speed pinion. It is believed that at least one of the disadvantageous or undesirable features of this type of past expanded scale timer involved the improbability of properly meshing the teeth of the pinion gears with that of the time interval gear as it was axially moved toward the pinion gears, and of course, it is believed that this attempt at moving the gearing axially to effect meshing thereof may also be accompanied by a backlash problem which also may have a disadvantageous effect on the gearing as well as the shafts to which such gearing is mounted.

In yet another of the past expanded scale timers, a segmented time interval gear was rotatable in driven relation between a low speed pinion and a high speed pinion to effect the dual operating modes of the timer. While this type of past expanded scale timer may have been desirable as compared with others of the past timers, it is believed that there was present the problem of a driving gap between the disengagement of the time interval gear from the low speed pinion and the engagement of the time interval gear with the high speed pinion which may be viewed in some respects as a disadvantageous or undesirable feature. Further, it is believed that the transition between the low and high speed modes of operation may also have resulted in a backlash problem which, of course, may also be disadvantageous.

Many other types of past expanded scale timers too numerous to discuss in detail utilized driving pawls, ratchet arrangements, stop pins, cam drivers as well as many other arrangements to effect dual speed operation but each is belived to be accompanied by various disadvantageous or undesirable features attendant to such arrangements.

SUMMARY OF THE INVENTION

Among the several objects of the present invention may be noted the provision of an improved timer device and an improved method of operating a timer device which overcomes the disadvantageous or undesirable features discussed hereinabove, as well as others, with respect to the prior art; the provision of such improved timer device and method which provide smooth time setting torque throughout an expanded time scale of the timer device; the provision of such improved timer device and method in which the drive of a fast speed gear train branch is initiated upon the interruption of the mesh of a slow speed gear train branch with both branches being continually in mesh with a means for indicating the remaining time of a selected operating time period for the timer device; the provision of such improved timer device and method including a switch device with manual means for controlling the "on" time of such switch device; and the provision of such improved timer device and method in which the component parts utilized therein are simplistic in design, easily assembled and economically manufactured. These as well as other objects and advantageous features of the present invention will be in part apparent and in part pointed out hereinafter.

In general, a method is provided in one form of the invention for operating a timer device having means rotatable for indicating the remaining operating time of a manually selected operating time period for the timer device. The timer device also has a clutch device and a pair of means connected in meshing relation with the indicating means for driving it in different preselected speed modes through the manually selected operating time period. In practicing this method, one of the driving means is actuated in its meshing relation with the indicating means to effect the driving of the indicating means in one of the speed modes through an operating period of time in exess of a predetermined operating time period with the sum of the excess and predetermined operating time periods comprising the manually selected operating time period for the timer device, and the clutch device is operated for overriding the meshing relation of the other of the driving means with the indicating means during the excess operating time period. A part of the one driving means in the meshing relation with the indicating means is disconnected from another part of the one driving means thereby to terminate the drive of the indicating means in the one speed mode by the first named part of the one driving means at the end of the excess operating time period while continuing the actuation of the another part of the one driving means, and at least generally simultaneously therewith, the clutch device is operated for drivingly associating the continuing operating another part of the one driving means with the other driving means in its meshing relation with the indicating means thereby to drive the indicating means in another of the speed modes through the predetermined operating time period.

Also in general and in one form of the invention, a timer device has means operable generally for indicating the remaining operating time of a selected operating time period of the timer device and a continuous gear associated with the indicating means. Gear train means operable generally for effecting the operation of the indicating means at different preselected speeds includes a pair of branches connected in meshing relation with the continuous gear, respectively. One of the branches in the meshing relation thereof with the continuous gear is operable to drive the indicating means at one of the preselected speeds through a time period in excess of a predetermined time period with the sum of the excess and predetermined time periods comprising the selected time period. Means is operable generally for disabling a part of the one branch in the meshing relation with the continuous gear and disassociating the part of the one branch from another part of the one branch with the another part of the one branch remaining operable upon the termination of the excess operating time period, and means is operable generally upon the disabling of the first named part of the one branch for effecting the conjoint operation of the other of the branches and the operable another part of the one branch with the other branch being in the meshing relation thereof with the continuous gear so as to drive the indicating means in another of the preselected speeds through the predetermined time period.

BRIEF DESCRIPTION OF THE DRAWINGS

Corresponding reference characters indicate corresponding parts throughout the several views of the drawings.

The exemplifications of the present invention set out herein illustrate preferred embodiments of such invention in one form thereof, and such exemplifications are not to be construed as limiting either the scope of such invention or the disclosure thereof in any manner.

DETAILED DESCRIPTION OF THE PREFERRED EMBODIMENTS

Figure 1:
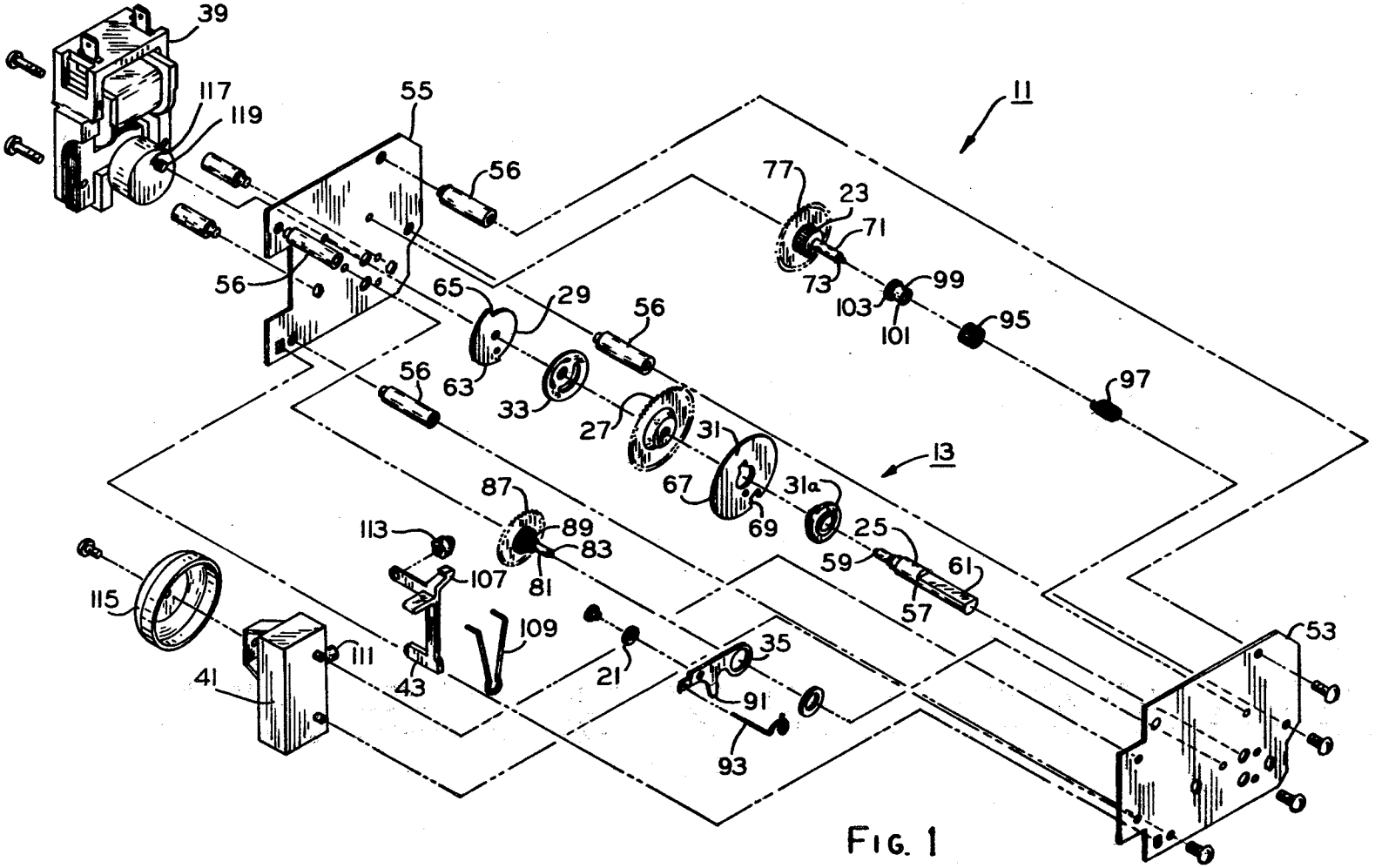
FIG. 1 is an exploded perspective view showing a timer device in one form of the invention and illustrating principles which may be practiced in a method of operating a timer device also in one form of the invention.
Figure 5:
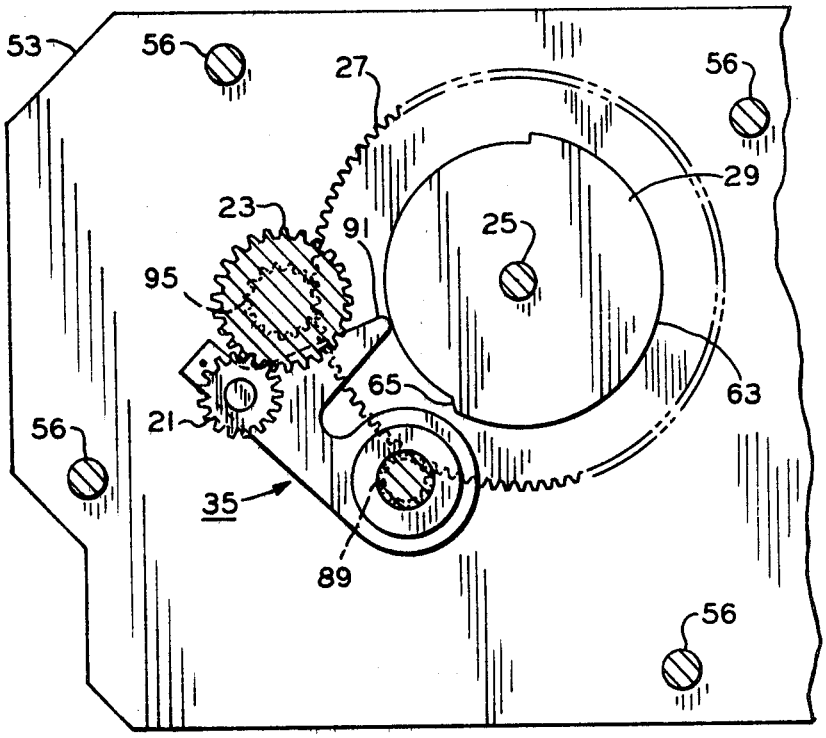
FIGS. 4 and 5 are sectional views taken along lines 4—4 and 5—5 in FIG. 3, respectively.
Figure 2:
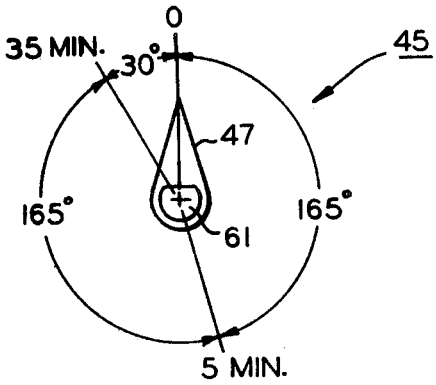
FIG. 2 is a schematic view of an expanded or elongate time setting scale for the timer of FIG. 1.
Figure 3:
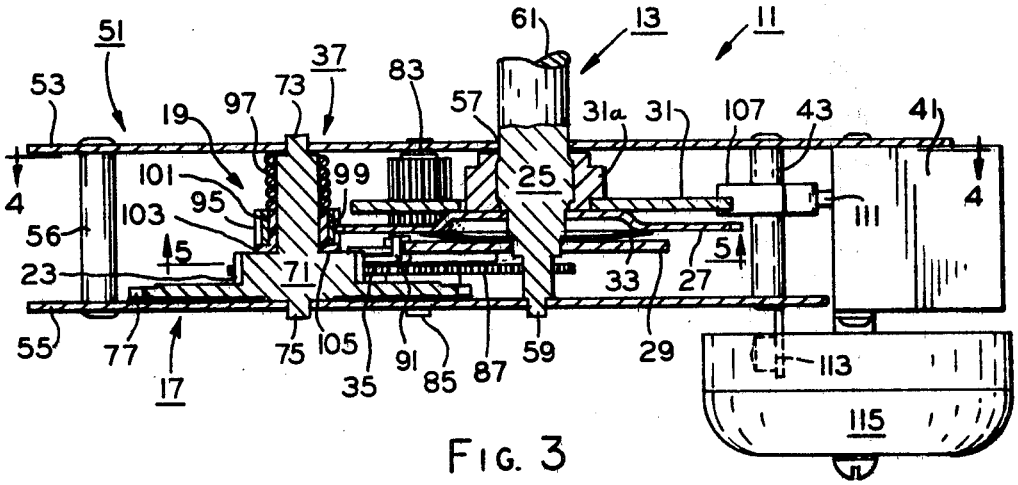
FIG. 3 is an enlarged side elevational view of the timer device of FIG. 1.
Figure 4:
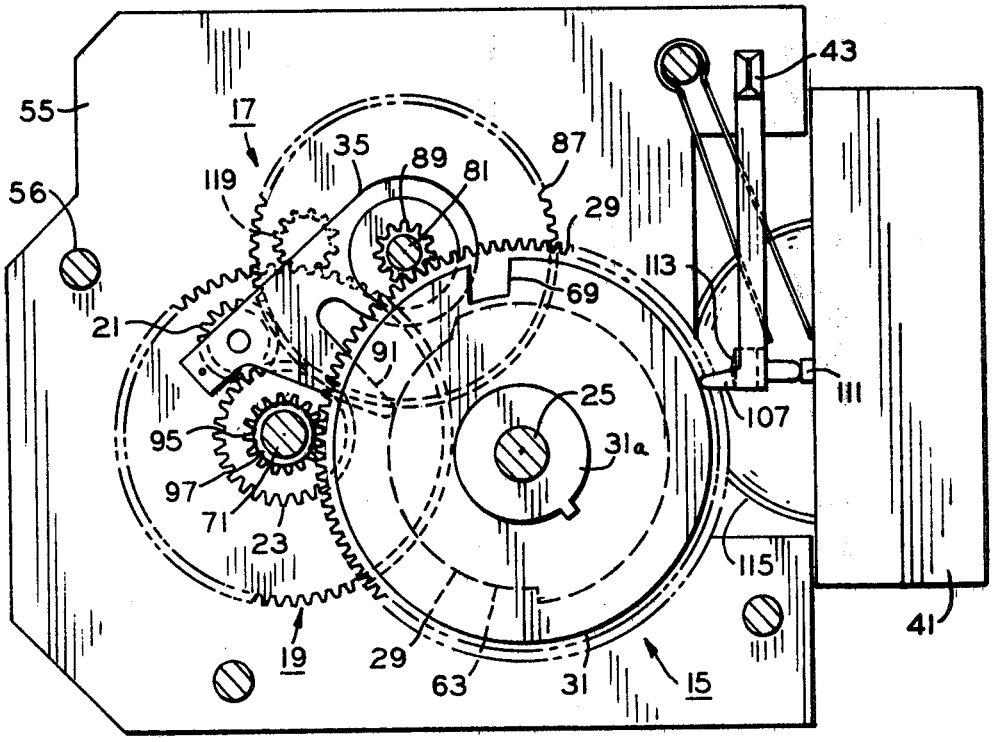

Referring now to the drawings in general, there is illustrated in one form of the invention a method of operating a timer device 11 having means, such as for instance, a time setting mechanism 13 or the like, for indicating the remaining operating time during an operating time period selected for the timer device (FIGS. 1-5). Timer device 11 also has a gear train 15 including a pair of branches 17, 19 coupled with time setting mechanism or indicating means 13 to drive it in different preselected speed modes, such as a high speed mode or fast speed and a low speed mode or slow speed for instance, through the selected operating time period of the timer device (FIGS. 1 and 2). In this method, time setting mechanism 13 is driven in its low speed mode through gear train branch 17 during an operating time period in excess of a predetermined operating time period of timer device 11 with the sum of the excess and predetermined operating time periods comprising the selected operating time period for the timer device, and the drive of the time setting mechanism is obviated through gear train branch 19 (FIGS. 2–4). At least one gear, such as for instance an idler gear 21 or the like of gear train branch 17, is moved to a position disengaged from mesh with at least another gear, such as for instance, a first reduction pinion 23 or the like, of gear train branch 17 interrupting the drive therethrough of time setting mechanism 13 to terminate the excess operating time period, and thereafter the time setting mechanism is driven in its high speed mode through gear train branch 19 during the predetermined operating time period of timer device 11 (FIGS. 1, 2 and 5).

More particularly and with specific reference to FIGS. 1–5, time setting mechanism 13 has a manually or operator operable, rotatable time setting shaft 25 including a continuous or output drive gear 27 rotatably mounted thereon, a pair of camming means or cams 29, 31, and a clutch device 33 operable between the continuous gear and cam 29. Cam 29 and a cam driver 31*a* are fixedly secured to time setting shaft 25, and cam 31 is carried by the cam driver with a preselected amount of lost motion therebetween which defines a preselected angular or rotation of freedom of cam 31 on the cam driver, as disclosed in greater detail hereinafter. Further, gear train branches 17, 19 are arranged in meshing or driving relation with continuous gear 27 so as to drive it, as well as time setting mechanism 13, in the low and high speed modes, respectively. Supporting means, such as for instance a pivotal lever 35 or the like, which carries idler gear 21 of gear train branch 17 is biased into following engagement with speed shift cam 29, and another clutch device 37 is operable between gear train branches 17, 19. Electric motor means 39 is provided for actuating gear train 15, and switch means 41 is provided for controlling the energization of the electric motor means. Timer device 11 also includes a switch means operating arm 43 biased toward following engagement with switch cam 31 of time setting mechanism 13.

Time setting shaft 25 may be manually rotated by an operator from an at-rest position thereof into a displaced position corresponding to the selected operating time period for timer device. For instance as shown schematically in FIG. 2, time setting shaft 25 extends through an expanded scale dial 45 which may be conveniently mounted to an appliance or apparatus (not shown) with which timer device 11 may be utilized. The initial or predetermined time period of timer device 11, as illustrated on expanded scale dial 45, may be about five minutes, and this five minute predetermined operating time period extends angularly from 0° to 165° on the dial. The aforementioned excess operating time period of timer device 11 is illustrated on dial 45 comprises the next thirty minutes which occupies only 165° thereof extending from 165° to 330°, and the last 30° of the dial is not utilized for timing purposes. While there is shown a predetermined operating time period of five minutes and an excess operating time period of thirty minutes for timer device 11, it is contemplated that other time periods of different lengths may be utilized within the scope of the invention so as to meet at least some of the objects thereof. An operator operable time indicator, such as a setting knob or pointer 47 for instance, may be attached to the exterior end of time setting shaft 25 by suitable means for operator actuation to conjointly rotate the time setting shaft and the pointer from the at-rest or zero time indicating position thereof to the displaced or selected operating time period indicating position thereof with respect to dial 45.

Upon the rotation of time setting shaft 25 to its displaced position indicative of the selected operating time period for timer device 11 chosen by the operator thereof, as discussed above, speed shaft cam and switch cams 29, 31 are conjointly rotatable with the time setting shaft so as to effect the camming of lever 35 and switch means operating arm 43, which are biased into following engagement with the cams, toward positions meshing idler gear 21 on the lever into gear train branch 17 and effecting the energization of electric motor means 39 through switch means 41, respectively. Of course, in order to conjointly rotate time setting shaft 25 and cams 29, 31 relative to continuous gear 27 which is meshed at all times in both gear train branches 17, 19, clutch device 33 is slipped between the continuous gear 27 and speed shift cam 29.

As previously mentioned, electric motor means 39 is drivingly associated with gear train 15; therefore, upon the energization of the electric motor means through switch means 41, gear train branch 17 is actuated or driven to commence or initiate the excess operating time period of timer device 11. Since idler gear 21 on lever 35 is biased into meshing engagement in gear train branch 17, the force of the driving or meshing engagement predeterminately so effected in gear train branch 17 is sufficient to overcome or override the gripping or clutching engagement of clutch device 37 between gear train branches 17, 19; therefore, clutch device 37 is slipped to obviate the actuation of gear train branch 19 when gear train branch 17 is actuated during the excess operating time period of timer device 11. In response to the meshed or driving relation of gear train branch 17 with continuous gear 27, as previously mentioned, gear train branch 17 effects the conjoint rotation of the continuous gear, time setting shaft 25 and cams 29, 31 in the slow speed mode of timer device 11 and in a counterclockwise direction, i.e., opposite the clockwise rotation of the time setting shaft when the selected operating time period was set into the timer device. Of course, upon the conjoint driven rotation of continuous gear 27 with time setting shaft 25, clutch device 33 is engaged in driving or clutching engagement therebetween.

Upon the conjoint driven rotation of time setting mechanism 13 by gear train branch 17, as discussed above, the excess operating time period of timer device 11 is terminated when speed shift cam 29 is rotated into a camming position with lever 35 which is biased into following engagement therewith, and the lever is cammed so as to move or otherwise pivot it and thereby disengage idler gear 21 on the lever from meshing engagement in gear train branch 17. Thus, upon the disengagement of idler gear 21 from gear train branch 17, the driving relation of gear train branch 17 with continuous gear 27 is, of course, interrupted, but it may be noted that a part of gear train branch 17 between the disengaged idler gear and electric motor means 39 remains or is continued to be actuated by the electric motor means when the excess operating time period of timer device 11 is terminated.

At least generally simultaneously with the interruption of the driving relation between gear train branch 17 and continuous gear 27 generally at the end of the excess operating time period, as discussed above, clutch device 37 grips in clutching engagement between gear train branch 19 and the part of gear train branch 17 continuing to be actuated by electric motor means 39, and gear train branch 19 is thus actuated which initiates the predetermined operating time period of timer device 11. The engagement of clutch device 37 is, of course, effected to establish the actuation of gear train branch 19 since the force of the driving engagement between gear train branch 19 and continuous gear 27 overcomes that of gear train branch 17 with the continuous gear upon the interruption of the driving relation thereof when idler gear 21 is displaced from meshing engagement in gear train branch 17. Thus, during the predetermined operating time period of device 11, rotation of time setting mechanism 13 is continued in the counterclockwise direction through the established driving relation between gear train branch 19 and continuous gear 27 of the time setting mechanism; however, it may be noted that such continued rotation of the time setting mechanism during the predetermined operating time period is shifted to the preselected high speed mode when gear train branch 19 is actuated. Of course, the rotation of time setting mechanism 13 during the predetermined operating time period of timer device 11 effects the conjoint rotation or return of cams 27, 29 and time setting shaft 25 to the at-rest position thereof which terminates the predetermined operating time period. At the end of the predetermined time period, switch means operating arm 43 in its following engagement with switch cam 31 is cammed by the switch cam toward a position effecting the deenergization of electric motor means 39 through switch means 41. Of course, upon this deenergization of electric motor means 39 when the predetermined operating time period of timer device 11 is terminated, the component parts of the timer device are returned to their at-rest positions repositioned for subsequent operator operation to set another selected operating time period for the timer device which, of course, would effect its cycle through the excess and predetermined operating time periods as discussed hereinabove.

With reference again to the drawings in general and recapitulating at least in part with respect to the foregoing, timer device 11 in one form of the invention is adapted for timing through an operating time period selected therefor by an operator (FIGS. 1–5). Timer device 11 has means, such as time setting mechanism 13 for instance, adapted to be rotatably driven for indicating the remaining operating time in the selected operating time period for the timer device (FIG. 1). A pair of means, such as for instance gear train branches 17, 19 or the like, are interconnected in driving relation or meshing engagement with time setting mechanism or indicating means 13 and are operable generally successively for driving the time setting mechanism in different preselected speed modes through an operating time period in excess of a predetermined operating time period for timer device 11 with the sum of the excess and predetermined operating time periods constituting the selected operating time period for the timer device (FIGS. 1, 2, 4 and 5). Means, such as electric motor 39 or the like for instance, is provided for imparting or applying a motive force to the driving means or gear train branches 17, 19 to actuate them and effect the driving relation thereof with time setting mechanism 13, and means, such as for instance lever 35 or the like for association with the time setting mechanism, is operable at the end of the excess time operating period for terminating the driving relation of a part of gear train branch 17 with the time setting mechanism in one of the speed modes while the drive or activation of another part of gear train branch 17 with electric motor or actuating means 39 is continued (FIGS. 1, 4 and 5). Means, such as clutch device 37 or the like for instance, is operable generally for establishing the driving relation of gear train branch 19 with time setting mechanism 13 through the another or continuing actuated part of gear train branch 17 in another of the speed modes to initiate the predetermined operating time period of timer device 11 upon the termination of the driving relation between gear train branch 17 and the time setting mechanism (FIGS. 1, 4 and 5).

More particularly and with specific reference to FIGS. 1 and 3–5, timer device 11 is provided with a housing 51 having a pair of opposite face plates or wall means 53, 55 spaced apart and retained against displacement by a plurality of posts 56 fixedly interconnected therebetween by suitable means (not shown). Time setting shaft 25 has a pair of opposite end portions 57, 59 respectively rotatably arranged with face plates 53, 55 of housing 51, and end portion 57 has an extension 61 which extends through face plate 53 exteriorly of the housing. As best seen in FIG. 2, pointer 47, which may be a part of an operator knob or the like for instance (not shown), is connected for conjoint rotation with time setting shaft extension 61. As previously mentioned, cams or cam means 29, 31 are interconnected with time setting shaft 25 so as to be generally conjointly rotatable therewith, and continuous gear 27 is rotatably received about the time setting shaft between the cams. Clutch device 33, which may be a wavy washer or the like for instance, is carried on time setting shaft 25 and disposed in slipping and clutching engagement between continuous gear 27 and cam 29. Thus, due to the action of clutch device 33, continuous gear 27 is both conjointly rotatable with time setting shaft 25 and relatively rotatable with respect thereto, as discussed in greater detail hereinafter. Speed shift cam 29 is provided with a peripheral cam surface 63 having a configuration defining a rise or fall 65 thereon, and switch cam 31 has a peripheral cam surface 67 having a configuration defining a recess or notch 69 therein, as further discussed hereinafter.

Gear train branch 17 is provided with a shaft 71 having a pair of opposite end portions 73, 75 respectively rotatably arranged with opposite face plates 53, 55 of housing 51, and a first reduction gear 77 and first reduction pinion 23 are integral with shaft 71 so as to be conjointly rotatable therewith. Another shaft 81 has a pair of opposite end portions 83, 85 respectively rotatably arranged with opposite face plates 53, 55 of housing 51, and a second reduction gear and pinion 87, 89 are integral with shaft 81 so as to be conjointly rotatable therewith. Second reduction gear 87 is meshed with idler gear 21 which is, in turn, meshed with first reduction pinion 23 on shaft 71, and second reduction pinion 89 is meshed with continuous gear 27 on time setting shaft 25. Lever 35 is pivotally supported or arranged about shaft 81 by suitable means between second reduction gear and pinion 87, 89, and a depending flange 91 on the lever defines a cam follower for following engagement with cam surface 63 of speed shift cam 29. Idler gear 21 is rotatably mounted on lever 35 so as to be both rotatably movable relative thereto and conjointly pivotally movable with the lever, as discussed in greater detail hereinafter, and resilient means, such as for instance a spring 93 is biased between front plate 53 and the lever for urging cam follower 91 thereon toward the following engagement with cam surface 63 of speed shift cam 29. Therefore, the compressive force of spring 93 is exerted on lever 35 for urging or pivoting it about shaft 81 in a direction not only to bias cam follower 91 on the lever into following engagement with cam surface 63 on speed shift cam 29 but also to bias idler gear 21 on the lever toward meshing engagement with first reduction pinion 23 on shaft 71 and second reduction gear 87 on shaft 81. In light of the foregoing, gear train branch 17 includes first reduction gear and pinion 77, 23, second reduction gear and pinion 87, 89 and idler gear 21, and when the idler gear is biased into mesh with gear train branch 17, as discussed above, the gear train branch is interconnected in driving or meshing relation with continuous gear 27 of time setting mechanism 13 through the meshing engagement at all times of the second reduction pinion with the continuous gear.

Gear train branch 19 is coupled through clutch device 37 with gear train branch 17 and is arranged in driving relation with continuous gear 27 on time setting shaft 25 so as to drive time setting mechanism 13 in the high speed mode during the predetermined operating time period of timer device 11, as discussed in detail hereinafter. Gear train branch 19 is provided with a third reduction pinion 95 mounted so as to be rotatable about shaft 71, and the third reduction pinion is meshed at all times with continuous gear 27 on time setting shaft 25. Clutch device 37 comprises a coil spring 97 biased between face plate 53 and a washer 99 formed of any suitable material having a sleeve portion 101 disposed between third reduction pinion 95 and shaft 71 and an integral radially extending flange portion 103 interposed between a face of the third reduction pinion and both an opposite face on first reduction pinion 23 and a shoulder 105 provided adjacent thereto on shaft 71. Of course, clutch device 37 is operable generally for slipping third reduction gear 95 when gear train branch 17 is actuated or operated to drive time setting mechanism 13 in the slow speed mode thereof during the excess operating time period of timer device 11 and also for clutching or gripping engagement between first and third reduction pinions 23, 95 to effect the conjoint rotation thereof and the actuation of gear train branch 19 to drive the time setting mechanism in the fast speed mode thereof during the predetermined operating time period of the timer device, as discussed in greater detail hereinafter. Although clutch device 37 is shown for purposes of disclosure, it is contemplated that various other types of clutch devices of different constructions may be utilized within the scope of the invention so as to meet at least some of the objects thereof.

Switch operating arm or cam follower 43 is pivotally mounted by suitable means between face plates 53, 55, and a detent 107 on the free end of the switch operating arm is urged by the compressive force of a spring 109 toward following engagement with cam surface 67 of switch cam 31. Detent 107 is disposed in an at-rest position within notch 69 in cam surface 67 of switch cam 31. When switch operating arm 43 is displaced from notch 69 against the compressive force of spring 109, the switch operating arm actuates a push button 111 of electrical switch 41 thereby to effect the energization of electric motor 39 connected in circuit therewith, as further discussed hereinafter. Switch 41 may be a model 3ASM5 available from the General Electric Company, Morrison, Ill.; however, it is contemplated that various other types of switches may be utilized within the scope of the invention so as to meet at last some of the objects thereof. Switch 41 may also be effective to control an appliance or the like (not shown) with which timer device 11 may be associated. A clapper 113 is attached to switch operating arm 43 for ringing a bell 115 at the end of the selected operating time period of timer device 11. Electric motor 39 is mounted by suitable means to face plate 53 of timer device 11, and a drive or motor shaft 117 of the electric motor extends through the face plate. To complete the description of timer device 11, a motor pinion 119 is carried on the end of motor shaft 117 extending from a gear reduction mechanism associated with electric motor 39 into meshing engagement with first reduction gear 77 on shaft 71 so as to effect the actuation of gear train branch 17 upon the energization of electric motor 39 which, as previously mentioned, is connected in circuit relation with switch 41.

In the operation of timer device 11 with its component parts in the respective at-rest positions thereof as illustrated in the drawings, the selected operating time period of the timer device may be initiated by an operator applying a force on pointer 47 to move it clockwise with respect to expanded scale 45, as best seen in FIG. 2. Assuming that the selected operating time period desired in in excess of the predetermined operating time period for timer device 11, the operator applied force movement of pointer 47 will move it from its at-rest position at 0° on dial 45 through the predetermined operating time period, i.e., from 0° to 165° on the dial, to an operator selected time set position within the excess operating time period in the last 165° of the dial.

The clutching engagement of clutch device 33 between cam 29 and continuous gear 27 is overcome by the operator applied force through pointer 47 on time set shaft 25 since the continuous gear is in meshing engagement at all times with gear train branches 17, 19, as previously discussed. Therefore, clutch device 33 slips continuous gear 27, and the time setting shaft 25 and cams 29, 31 are conjointly rotatable in response to the operator applied force from their at-rest positions to the displaced positions thereof as determined by the selected operating time period chosen by the operator while continuous gear 27 remains stationary. Upon this time setting conjoint rotation of time setting shaft 25 and cams 29, 31, cam configuration 65 on cam surface 67 of speed shift cam 29 is rotated past cam follower 91 on lever 35 to the displaced position shown in FIG. 4 for instance. In response to the compressive force of spring 93 acting on lever 35, the lever is pivoted about shaft 81 so as to move idler gear 21 carried on the lever into meshing engagement in gear train branch 17 while cam follower 91 on the lever remains biased in following engagement with cam surface 63 of speed shift cam 29. The conjoint rotation with time setting shaft 25 and speed shift cam 29 of switch cam 31 effects the displacement from its notch 69 of detent 107 on switch operating arm 43 against the compressive force of spring 109. In this manner, when detent 107 is displaced from notch 69 in switch cam 31, the compressive force of spring 109 urges the detent toward following engagement with cam surface 67 of the switch cam, and switch operating arm 43 is thereby pivoted toward a position actuating push button 111 of electrical switch 41 to initiate the energization of electric motor 39 connected in circuit relation with the switch.

Upon its energization, electric motor 39 rotates its pinion 119 to initiate the drive or actuation of gear train branch 17 through the excess operating time period of timer device 11. Since the force of the driving or meshing engagement through gear train branch 17 to continuous gear 27 is sufficient to overcome or override the frictional gripping or clutching engagement of clutch device 37 between gear train branches 17, 19, the clutch device slips third reduction pinion 95 of gear train branch 19. Thus, the slippage of clutch 37 obviates the actuation of gear train branch 19 during the excess operating time period of timer device 11 while effecting the actuation of gear train branch 17. During the excess operating time period of timer device 11, the driving relation of gear train branch 17 with continuous gear 27 effects the driven return rotation of time setting mechanism 13 in the clockwise direction, i.e., opposite the counterclockwise time setting rotation. At the end of the excess time period of timer device 11, the return rotation of speed shift cam 29 on time setting mechanism 13 moves its cam configuration 65 to a camming position into camming engagement with cam follower 91 on lever 35, and in response to this camming engagement, the lever is pivoted about shaft 81 toward a pivotally displaced position disengaging idler gear 21 carried on the lever from meshing engagement with first reduction pinion 23 on shaft 71 and second reduction gear 87 on shaft 81 in gear train branch 17. In this manner, the disengagement of idler gear 21 from mesh in gear train branch 17 interrupts the driving or meshing relation of gear train branch 17 with continuous gear 27 on time setting mechanism 13 while a part of gear train branch 17, i.e., first reduction gear and pinion 77, 23 on shaft 71 continues to be actuated or operated by electric motor 39. Thus, the interruption of the driving relation through gear train branch 17 of continuous gear 27 terminates the excess operating time period of timer device 11, and at the end of the excess operating time period, pointer 47 in its conjoint return rotation with time setting mechanism 13 has been returned from its selected operating time position to the five minute mark on dial 45.

At least generally simultaneously with the interruption of the driving relation between gear train branch 17 and continuous gear 27 terminating the excess operating time period of timer device 11, the force of the meshing engagement through gear train branch 19 to the continuous gear is sufficient to effect the clutching engagement of clutch device 37 between first and third reduction pinions 23, 95 on shaft 71. In this manner, the clutching engagement of clutch device 37 between the aforementioned part of gear train branch 17 continuing its actuation by electric motor 39 and gear train branch 19 thereby effects the actuation of gear train branch 19 in its driving or meshing relation with continuous gear 27. Of course, the transition from the excess operating time period into the predetermined operating time period of timer device 11 occurs upon the actuation of gear train branch 19, as discussed above, and the driving relation of gear train branch 19 with continuous gear 27 effects the return rotation thereof conjointly with time setting mechanism 13 through the predetermined operating time period of the timer device. It may be noted that due to the clutching action of clutch device 37, the transition from the low speed mode drive of gear train branch 17 during the excess operating time period into the high speed mode drive of gear train branch 19 during the predetermined operating time period is not only at least generally simultaneous but also generally smooth with continuous gear 27 being meshed in engagement at all times with each gear train branch.

At the end of the predetermined operating time period, the conjoint return rotation of time setting mechanism 13 and pointer 47 effected by the driving relation of gear train branch 19 with continuous gear 25 returns cams 29, 31 to their at-rest positions. When pointer 47 attains its 0° reading on dial 45, switch cam 31 will be rotated a few degrees in the counterclockwise direction by the engagement of detent 107 on switch operating arm 43 with cam surface 67 generally at notch 69 therein in response to the compressive force of spring 109, and the amount of such counterclockwise rotation is determined by the lost motion between cam driver **31*a* and switch cam 31, as previously mentioned. As a result of the aforementioned counterclockwise rotation of switch cam 31, the compressive force of spring 109 urges switch operating arm 43 with snap action back into its at-rest position so as to dispose detent 107 within notch 69 in the switch cam. Since clapper 113 is conjointly movable with switch operating arm 43, the snap action return movement thereof causes the clapper to strike bell 115 thereby to sound an alarm that the selected operating time period of timer device 11 has terminated. At the same time, push button 111 of electrical switch 41 is also released or disengaged by the return movement of switch operating arm 43 thereby to deactuate the electrical switch. Of course, this deactuation of electrical switch 41 effects the deenergization of electrical motor 39 thereby to terminate the motive or drive force thereof. In this manner, the return of the component parts of timer device 11 to their respective at-rest positions effects the deenergization of electric motor 39**, and the component parts of the timer device are again poised for a subsequent timing cycle upon the initiation thereof by the operator.

Figure 6:
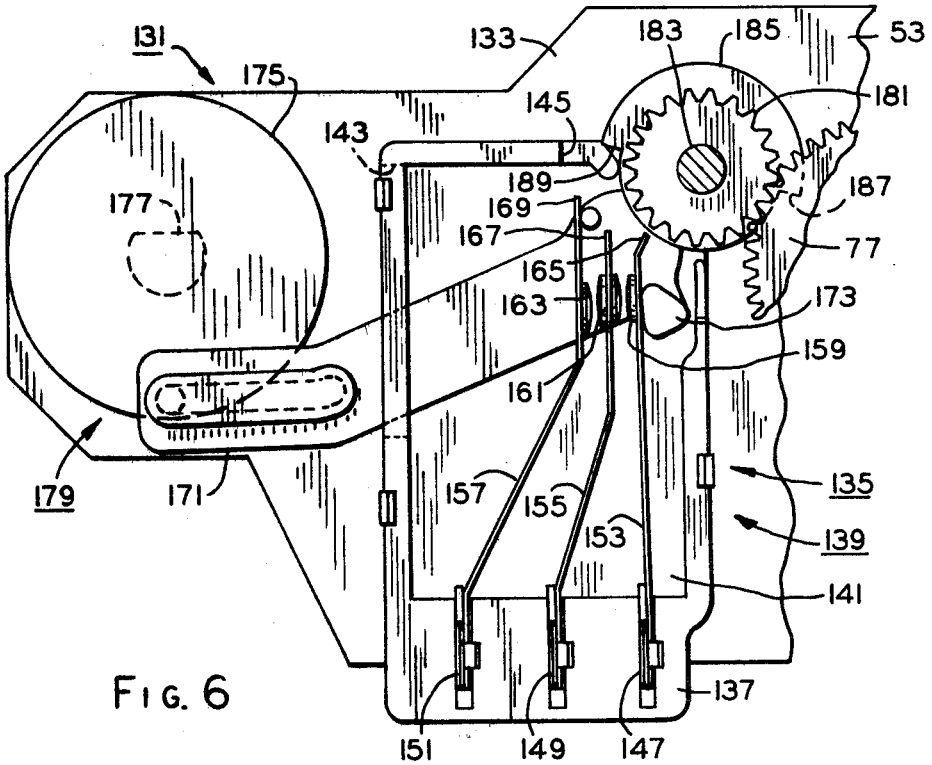
FIG. 6 is a partial sectional view of an alternative timer device in one form of the invention showing a switching mechanism thereof associated with the timer device of FIG. 1 and illustrating principles which may be practiced in an alternative method of operating a timer device also in one form of the invention.

Referring now to FIG. 6, an alternative timer device 131 in one form of the invention is shown illustrating principles which may be utilized in an alternative method of operating the timer device also in one form of the invention, and timer device 131 has generally the same component parts functioning generally in the same manner as previously described with respect to timer device 11 with the exceptions discussed hereinafter. While timer device 131 meets at least some of the objects set out herein, it is believed that timer device 131 may have additional indigenous objects which will be in part apparent and in part pointed out in the followng discussion.

In timer device 131, front face plate 51 is provided with an extension 133 to which is secured another switch or switch device 135 having a housing 137 with a plurality of wall means 139 defining a chamber 141 therewithin, and a pair of openings 143, 145 are provided through the housing wall means communicating with the chamber. A plurality of terminals 147, 149 151 are mounted in switch housing 137 so as to support a plurality of switch elements 153, 155, 157 within chamber 141 of the switch housing, respectively. A plurality of contacts 159, 161, 163 are secured to switch elements 153, 155, 157 adjacent free ends 165, 167, 169 thereof, respectively, and contact 161 on switch element 155 is a double contact for making with and breaking from contacts 159, 163 on switch elements 153, 157, respectively.

Means, such as a switch operating lever or arm 171 for instance, for setting or positioning switch elements 153, 155, 157 is pivotally mounted to housing 137 of switch 135 within chamber 141 thereof, and the lever extends through opening 143 provided therefor in the housing. Means, such as a pin or an abutment 173 for instance, is provided on the interior end of lever 171 within housing chamber 141 for abutment or actuating engagement with switch element 153, and the exterior end of the lever without switch 135 is operatively or drivingly connected with a cam actuator 175. Cam actuator 175 is connected for conjoint rotation with a mode selector shaft 177 rotatably mounted by suitable means to front plate extension 133, and the mode selector shaft is manually rotatable by an operator between a pair of mode selecting positions, such as a "cook" position and a "defrost" position for instance, for setting switch 135, as discussed in detail hereinafter. Thus, switch 135 and mode selector shaft 177 comprise a mode selecting mechanism 179 for time device 131. A camming gear 181 is conjointly rotatable with a shaft 183 therefor which is rotatably mounted in end plates 51, 53 of timer device 131 with the camming gear being meshed in driven engagement with first reduction gear 77, and a cycling cam 185 having plurality of cam configurations 187, 189 thereon is arranged so as to be conjointly rotatable with the camming gear and the shaft with the cam configurations passing through opening 145 provided therefor in switch housing 137 for actuating or camming engagement with free ends 165, 167, 169 of switch elements 153, 155, 157, respectively. While cycling cam 185 is illustrated as having two cam configurations 187, 189 thereon, it is contemplated that other cycling cams having a different number of cam configuration may be utilized within the scope of the invention so as to meet at least some of the objects thereo.

In the operation, assume that the operator has actuated time setting mechanism 13 to set the selected operating time period for time device 131, as previously discussed, and assume that the operator has rotated mode selection mechanism 179 to position the component parts of timer device as shown in FIG. 6 and thereby effect the defrost cycling mode or operation of the timer device.

When timer device 131 begins to time through the selected operating time period, the meshing engagement between cycling gear 181 and first reduction gear 77 in gear train 15 of timer device 131 effects the conjoint rotation of the cycling gear in the clockwise direction, as best seen in FIG. 6. Since cycling gear 181 and cycling cam 185 are conjointly rotatable with shaft 183, the driven rotation of the cycling gear initially rotates cam configuration 187 of the cycling cam into camming engagement with free end 165 of switch element 153 moving it to a position making its contact 159 with double contact 161 on switch element 155, and albeit not shown for the sake of brevity of disclosure, a magnetron of a microwave type oven is energized through a surge protection resistor through switch elements 153, 155 upon the making of contacts 159, 161 thereof, respectively. Within seconds after the making of contacts 159, 161, further driven rotation of cycling cam 181 conjointly moves switch elements 153, 155 in a direction to also make double contact 161 on switch element 155 with contact 163 on switch element 157. Thus, with contacts 159, 161, 163 on switch elements 153, 155, 157 disposed in making engagement, the aforementioned surge protection resistor is bypassed so that the magnetron of the microwave oven is energized in the defrost mode. After about fifteen seconds for instance, cycling cam 185 is further rotated to a camming position passing its other cam configuration 189 beneath free end 165 of switch element 153. When cam configuration 189 of cycling cam 185 passes free end 165 of switch element 153, the switch element disengages the cycling cam and returns to its at-rest position in abutment with pin 173 on lever 171 of switch 135. Upon the return of switch element 153 into engagement with pin 173 of lever 171, contacts 159, 161 break permitting switch element 155 to also return to its at-rest position. When switch element 155 returns to its at-rest position, contacts 161, 163 break permitting switch element 157 to return to its at-rest position. Of course, the breaking of contacts 159, 161, 163, as discussed above, opens the various circuits of the aforementioned microwave oven connected therewith to terminate the defrost cycle of timer device 131. However, continued driven rotation of cycling cam 185 effects successive camming operation of switch elements 153, 155, 157 throughout the selected operating time period for timer device 131 thereby to effect successive defrost mode operation of the timer device in the manner discussed above.

Figure 7:
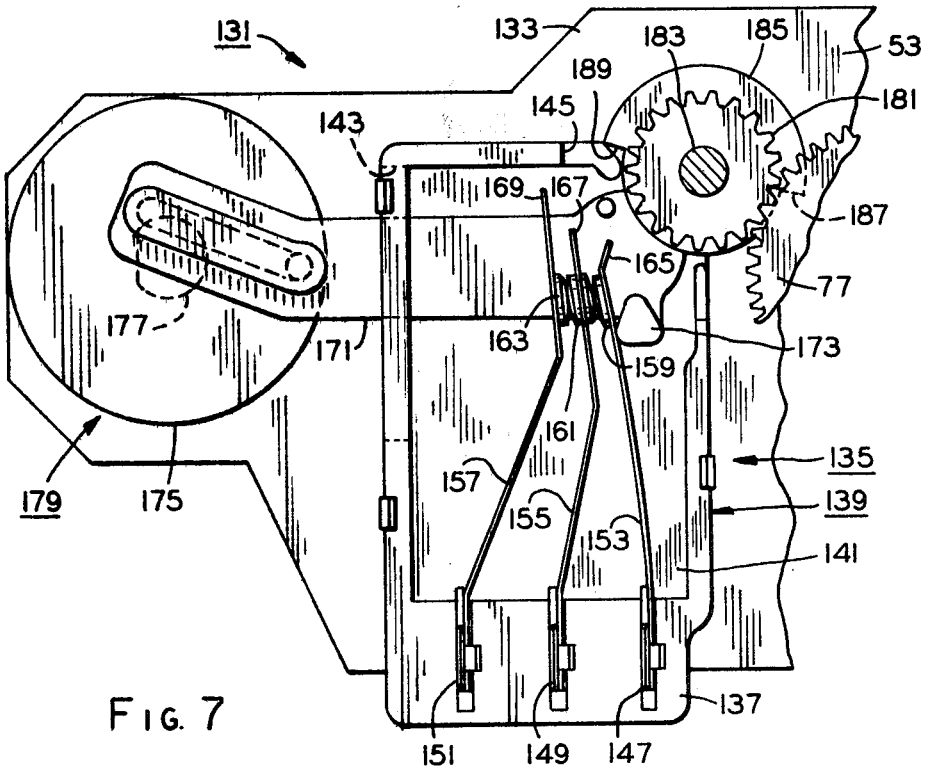
FIG. 7 is a partial view taken from FIG. 6 illustrating a switching mode of the switch.

When the operator desires to set timer device 131 in its cooking mode, mode selector mechanism 179 is rotated from its defrost mode position to its cooking position thereby to pivot lever 171 of switch 135 into the position thereof illustrated in FIG. 7. In this pivoted position of lever 171, pin 173 thereon drives switch elements 153, 155, 157 to effect the making of contacts 159, 161, 163 thereon, respectively, and with the switch elements so held in their contact making position by the lever, it may be noted that free end 165 of switch element 153 is displaced from camming engagement with cycling cam 185 as it is rotated in response to the meshing of cycling gear 181 with first reduction gear 77 in gear train 15 of timer device 131 when it is actuated.

From the foregoing, it is now apparent that novel timer devices 11, 131 and novel methods of operating such timer devices are presented meeting at least the objects set out hereinabove, and it is contemplated that changes as to the precise arrangements, shapes, connections and details of the constructions illustrated herein by way of example for purposes of disclosure, as well as the precise steps and order thereof in the methods, may be made by those having ordinary skill in the art without departing from the spirit of the invention or the scope thereof as defined by the claims which follow.

What we claim as new and desire to secure by Letters Patent of the United States is:

1. A method of operating a timer device having a rotatable time setting shaft including a continuous gear rotatable thereon, a pair of cams connected with the shaft, and a first clutch operable between the continuous gear and one of the cams, a gear train including a pair of branches arranged in driving relation with the continuous gear so as to drive it in a high speed mode and a low speed mode, respectively, a pivoted lever carrying an idler gear of one of the gear train branches and biased toward following engagement with one of the one cam and the other of the cams, and a second clutch operable between the gear train branches, the timer device also having electric motor means for actuating the gear train, switch means for controlling the energization of the electric motor means, and a switch means operating arm biased toward following engagement with the other of the one and other cams, the method comprising the steps of:

manually rotating the time setting shaft in one direction from an at-rest position into a displaced position to select an operating time period for the timer device with the selected operating time period comprising the sum of a predetermined operating time period of the timer device and another operating time period in excess of the predetermined operating time period;

conjointly rotating the cams with the time setting shaft from the at-rest position into the displaced position thereof so as to effect the camming of the lever and the switch means operating arm respectively biased into following engagement with the cams toward positions meshing the idler gear on the lever in the one gear train branch and energizing the electric motor means through the switch means and slipping the first clutch between the one of the one and other cams and the continuous gear during the conjoint rotation of the cams with the time setting shaft in the one direction;

actuating the one gear train branch upon the energization of the electric motor means to initiate the another operating time period of the timer device and slipping the second clutch between the gear train branches to obviate actuation of the other of the gear train branches during the another operating time period of the timer device;

effecting, in response to the driving relation of the one gear train branch with the continuous gear, the conjoint rotation in the slow speed mode and in another direction opposite the one direction of the continuous gear, the cams and the time setting shaft with the first clutch engaging between the continuous gear and the one of the one and other cams during the another operating time period of the timer device;

terminating the another operating time period of the timer device upon the rotation in the another direction of the other of the one and other cams toward a camming position with the lever in the following engagement thereof and camming the lever so as to pivot it and disengage the idler gear on the lever from meshing engagement in the one gear train branch;

interrupting the driving relation between the continuous gear and the one gear train branch upon the disengagement therefrom of the idler gear on the lever and continuing the actuation of a part of the one gear train branch;

engaging the second clutch between the other gear train branch and the continuing actuated part of the one gear train branch generally simultaneously with the interruption of the driving relation between the continuous gear and the one gear train branch and actuating thereby the other gear train branch to initiate the predetermined operating time period of the timer device;

continuing the conjoint rotation in the another direction but in the high speed mode of the continuous gear, the cams and the time setting shaft in response to the driving relation between the continuous gear and the other gear train branch during the predetermined operating time period of the timer device and returning the cams and the time setting shaft to the at-rest positions thereof at the end of the predetermined operating time period of the timer device; and camming the switch means operating arm in its following engagement with the other cam into a position effecting the deenergization of the electric motor means upon the return of the other of the one and other cams to its at-rest position at the end of the predetermined operating time period of the timer device.

2. The method as set forth in claim 1 wherein the timer device also has a cycling cam, and another switch means for operation in a set of switching modes including a set of switch elements arranged for switching operation and comprising the intermediate step of actuating the cycling cam conjointly with at least the continuing actuated part of the one gear train branch and cyclically engaging the cycling cam with at least one of the switch elements to cyclically effect the switching operations thereof during at least one of the operating modes of the another switch means.

3. A method of operating a timer device having rotatable means for indicating the remaining operating time during an operating time period selected for the timer device by an operator and including a cam conjointly rotatable therewith, a gear train including a pair of branches arranged in driving relation with the rotatable means to drive it in a low speed mode and a high speed mode, respectively, a pivoted lever carrying a gear of one of the gear train branches, and a clutch associated with the gear train branches, the method comprising the steps of:

biasing the lever toward a position in following engagement with the cam and meshing the gear on the lever with confronting other gears of the one gear train branch;

actuating the one gear train branch in its driving relation with the rotatable means and rotating conjointly the rotatable means and the cam in the low speed mode during an operating time period of the timer device in excess of a predetermined operating time period of the timer device with the sum of the excess and predetermined operating time periods comprising the selected operating time period for the timer device;

slipping the clutch to obviate rotation of the rotatable means through the driving relation therewith of the other of the gear train branches during the excess operating time period;

camming the lever in its following engagement with the cam toward a pivoted position disengaging the gear on the lever from the confronting other gears of the one gear train branch thereby to interrupt the actuation of a part of the one gear train branch in driving relation with the rotatable means generally at the end of the excess operating time period and continuing the actuation of another part of the one gear train branch drivingly disassociated from the first named part of the one gear train branch upon the disengagement of the gear on the lever from the confronting other gears of the one gear train branch;

engaging the clutch between the other gear train branch and the another part of the one gear train branch continued to be actuated upon the interruption of the actuation of first named part of the one gear train branch in the driving relation thereof with the rotatable means; and driving the other gear train branch through the continuing actuation of the another part of the one gear train branch upon the engagement of the clutch between the other gear train branch and the another part of the one gear train branch and rotating conjointly the rotatable means and the cam in the high speed mode through the predetermined operating time period of the timer device in response to the driving relation of the other gear train branch with the rotatable means.

4. A method of operating a timer device having means rotatable for indicating the remaining operating time of a manually selected operating time period for the timer device, a pair of means connected in meshing relation with the indicating means for driving it in different preselected speed modes through the manually selected operating time period for the timer device, respectively, and a clutch device, the method comprising the steps of:

actuating one of the driving means in its meshing relation with the indicating means to effect the driving of the indicating means in one of the speed modes through an operating period of time in excess of a predetermined operating time period with the sum of the excess and predetermined operating time periods comprising the manually selected operating time period for the timer device and operating the clutch device for overriding the meshing relation of the other of the driving means with the indicating means during the excess operating time period; and disconnecting a part of the one driving means in the meshing relation with the indicating means from another part of the one driving means thereby to terminate the drive of the indicating means in the one speed mode by the first named part of the one driving means at the end of the excess operating time period while continuing the actuation of the another part of the one driving means and, at least generally simultaneously therewith, operating the clutch device for drivingly associating the continuing actuated another part of the one driving means with the other driving means in its meshing relation with the indicating means thereby to drive the indicating means in another of the speed modes through the predetermined operating time period.

5. The method as set forth in claim 4 wherein the actuating and operating step includes slipping the clutch device to obviate driving the other driving means in the meshing relation thereof with the indicating means.

6. The method as set forth in claim 4 wherein the timer device has electric motor means for actuating the driving means and wherein the actuating and operating step includes initiating the energization of the electric motor means.

7. The method as set forth in claim 4 wherein the one driving means includes a separable part and wherein the disconnecting and operating step includes moving the separable part toward a displaced position separating it from at least one of the first named part of the one driving means and the continuing actuated another part of the one driving means.

8. The method as set forth in claim 4 wherein the disconnecting and operating step includes engaging the clutch device between the continuing actuated another part of the one driving means and the other driving means.

9. The method as set forth in claim 4 wherein the timer device also has a cycling cam, and switch means for operation in a set of switch modes including a set of switch elements arranged for switching operation with respect to each other and wherein the actuating and operating step includes driving the cycling cam with the continuing actuated another part of the one driving means and cyclically engaging the cycling cam with at least one of the switch elements to cyclically effect the switching operation of the switch elements during at least one of the operating modes of the switch means.

10. A method of operating a timer device having means rotatable for indicating the remaining operating time during an operating time period selected for the timer device, a continuous gear rotatable on the indicating means, and a gear train including a pair of branches associated in meshing engagement with the continuous gear and operable generally to drive the indicating means in different preselected speed modes through the selected operating time period of the timer device, respectively, and a pair of clutch devices, the method comprising the steps of:

rotating the indicating means in one of the different preselected speed modes in response to the operation of one of the gear train branches in the meshing engagement thereof with the continuous gear and with one of the clutch devices effecting conjoint rotation of the continuous gear with the indicating means during an operating time period in excess of a predetermined operating time period of the timer device with the sum of the excess and predetermined operating time periods comprising the selected operating time period for the timer device and operating the other of the clutch devices for obviating the rotation of the indicating means through the other of the gear train branches in the meshing engagement thereof with the continuous gear during the excess operating time period; and moving at least one of the gears of the one gear train branch to a position disengaged from mesh with at least another gear of the one gear train branch interrupting the rotation therethrough of the indicating means so as to disassociate a part of the one gear train branch in meshing engagement with the continuous gear from another part of the one gear train branch and terminate the excess operating time period while continuing the operation of the another part of the one gear train branch and thereafter operating the other clutch device into gripping engagement with the continuing operated another part of the one gear train branch and the other gear train branch in its meshing engagement with the continuous gear to rotate the indicating means during the predetermined operating time period of the timer device.

11. The method as set forth in claim 10 wherein the timer device includes means pivotally supported therein for carrying the at least one gear of the one gear train branch and wherein the moving and operating step includes pivoting the supporting means with respect to the one gear train branch until the at least one gear attains its position disengaged from mesh with the at least another gear of the one gear train branch.

12. The method as set forth in claim 11 wherein the indicating means includes camming means conjointly driven therewith and wherein the moving and operating step further includes biasing the supporting means toward following engagement with the camming means.

13. The method as set forth in claim 12 wherein the moving and operating step further includes engaging a cam configuration on said camming means with the supporting means to effect the pivoting thereof.

14. The method as set forth in claim 10 comprising the preliminary step of manually turning the indicating means to rotate it to the selected operating time period.

15. A timer device comprising:

a housing having at least a pair of spaced apart opposite wall means;

a first shaft including a pair of first opposite end portions respectively rotatably arranged with said wall means and with one of said first opposite end portions extending through one of said wall means exteriorly of said housing, a pair of cam means on said first shaft for conjoint rotation therewith, an output drive gear rotatably received about said first shaft, and a first clutch means for slipping and clutching engagement between one of said cam means and said output drive gear, said first shaft and said cam means being rotatable conjointly in response to a manually applied rotative force on said one first opposite end portion to set a selected operating time period for the timer device with said first clutch means slipping between said output drive gear and said one cam means;

a first gear train branch adapted to rotatably drive said first shaft in a slow speed mode through an operating time period in excess of a predetermined operating time period of the timer device with the sum of the excess operating time period and the predetermined operating time period comprising the selected operating time period for the timer device said first gear train branch including a second shaft having a pair of second opposite end portions respectively rotatably arranged with said wall means, a first reduction gear and a first reduction pinion on said second shaft and conjointly rotatable therewith, a third shaft having a third pair of opposite end portions rotatably arranged with said wall means, respectively, a second reduction gear and a second reduction pinion on said third shaft and conjointly rotatable therewith with said second reduction gear and said second reduction pinion being respectively meshed with said first reduction pinion on said second shaft and said output drive gear on said first shaft, a lever pivotally supported about said third shaft and having a cam follower and an idler gear thereon, spring means exerting a force on said lever for pivoting it about said third shaft in a direction to urge said cam follower into following engagement with one of said one cam means and the other of said cam means on said first shaft and to urge said idler gear into meshing engagement with said first reduction pinion on said second shaft;

electric motor means mounted to the other of said wall means and having a motor driven pinion in driving meshing engagement with said first reduction gear on said second shaft, said electric motor means being operable when energized to actuate said first gear train branch and effect the rotation of said first shaft in its slow speed mode through the excess operating time period of the timer device, said one of said one and other cam means being conjointly driven with said first shaft to cam said cam follower on said lever and pivot said lever about said third shaft against the force of said spring means to a position disengaging said idler gear on said lever from said first reduction pinion on said second shaft thereby to terminate the drive of said first shaft by said first gear train branch at the end of the excess operation time period;

a second gear train branch coupled with said first gear train branch and arranged to rotatably drive said first shaft in a high speed mode through the predetermined operating time period of the timer device upon the termination of the rotatable drive of said first shaft by said first gear train branch, said second gear train branch including a third reduction pinion mounted so as to be rotatable about said second shaft and meshed with said output drive gear on said first shaft, and second clutch means interposed between said first and third reduction pinions on said second shaft and operable generally for slipping said third reduction pinion when said first gear train branch rotatably drives said first shaft during the excess operating time period of the timer device and for clutching engagement between said first and third reduction pinions so as to effect the conjoint driven rotation thereof with said second shaft in response to the energization of said electric motor means and to effect the driving of said first shaft in the high speed mode throughout the predetermined operating time period of the timer device;

switch means on said housing and operable generally for controlling the energization of said electric motor means; and switch actuating means for said switch means urged toward following engagement with the other of said one and other cam means on said first shaft, said other of said one and other cam means being conjointly driven with said first shaft to cam said switch actuating means toward a position effecting the operation of said switch means to deenergize said electric motor means at the end of the predetermined operating time period of the timer device.

16. A timer device as set forth in claim 15 further comprising another switch means on said housing for operation in a set of switching modes and including a set of switch elements arranged for switching operation during the operating modes of said another switch means; a fourth shaft having a fourth pair of opposite end portions respectively rotatably arranged with said wall means; a cycling gear and a cycling cam on said fourth shaft and conjointly rotatable therewith, said cycling gear being driven in mesh with said first reduction gear on said second shaft and said cycling cam being cyclically engaged with at least one of said switch elements to effect the switching operations of said switch elements during at least one of the operating modes of said another switch means.

17. A timer device adapted for timing through an operating time period selected therefor by an operator, the timer device comprising:

rotatable means operable generally for indicating the remaining operating time in the selected operating time period of the timer device and including at least one cam means for conjoint rotation therewith;

a gear train actuated to effect the operation of said rotatable means in different preselected speed modes and including a pair of branches connected in meshing relation with said rotatable means, respectively, one of said gear train branches being actuated to drive said rotatable means in one of the preselected speed modes through an operating time period in excess of a predetermined operating time period for the timer device with the sum of the excess and predetermined operating time periods comprising the selected operating time period for the timer device;

means movable in said timer device for association with said rotatable means and said gear train and including follower means for following engagement with said at least one cam means, and means for supporting at least one idler gear of said one gear train branch;

resilient means associated with said association means and operable generally for urging said follower means toward the following engagement thereof with said at least one cam means and for urging said at least one idler gear into meshing engagement in said one gear train branch, said at least one cam means being operable to cam said follower means and move said supporting means against said resilient means toward a position interrupting the meshing engagement between the at least one idler gear and a part of said one gear train branch in the meshing relation with said rotatable means generally at the end of the excess operating time period while another part of said one gear train branch remains actuated; and clutch means associated with the actuated another part of said one gear train branch and the other of said gear train branches for actuating it to drive said rotatable means in another of the preselected speed modes through the predetermined operating time period of the timer device.

18. A timer device comprising:

means operable generally for indicating the remaining operating time of a selected operating time period of the timer device;

a continuous gear associated with said indicating means;

gear train means operable generally for effecting the operation of said indicating means at different preselected speeds including a pair of branches connected in meshing relation with said continuous gear, respectively, one of said branches in the meshing relation thereof with said continuous gear being operable to drive said indicating means at one of the preselected speeds through a time period in excess of a predetermined time period with the sum of the excess and predetermined time periods comprising the selected time period;

means operable generally for disabling a part of said one branch in the meshing relation with said continuous gear and disassociating said part of said one branch from another part of said one branch with said another part of said one branch remaining operable upon the termination of the excess operating time period; and means operable generally upon the disabling of said first named part of said one branch for effecting the conjoint operation of the other of said branches and said operable another part of said one branch with said other branch being in the meshing relation thereof with said continuous gear so as to drive said indicating means in another of the preselected speeds through the predetermined time period.

19. A timer device adapted for timing through an operating time period selected therefor by an operator comprising:

means adapted to be rotatably driven for indicating the remaining operating time in the selected operating time period for the timer device;

a continuous gear associated with said indicating means;

a pair of means interconnected in meshing engagement with said continuous gear and operable generally for rotatably driving said indicating means in different preselected speed modes through an operating time period in excess of a predetermined operating time period and through the predetermined operating time period with the sum of the excess and predetermined operating time periods comprising the selected operating time period for the timer device;

means for actuating one of said driving means in its meshing engagement with said continuous gear to rotatably drive said indicating means in one of the different preselected speed modes;

means associated with said indicating means and operable generally at the end of the excess operating time period for disabling a part of said one driving means in the meshing engagement with said continuous gear and disassociating said part of said one driving means from another part of said one driving means while continuing to operate the drive of said another part of said one driving means by said actuating means; and means operable generally for interconnecting the other of said driving means and said another part of said one driving means with said other driving means being in the meshing engagement thereof with said continuous gear so as to rotatably drive said indicating means in another of the different preselected speed modes to initiate the predetermined operating time period upon the disabling of said first named part of said one driving means.

20. A timer device as set forth in claim 19 further comprising switch means for operation in a set of switching modes, and means associated in driven relation with said another part of said one driving means for cyclically effecting the operation of said switch means in one of the switching modes thereof.

* * * * *